United States Patent [19]

Ausnit et al.

[11] Patent Number: 4,832,505

[45] Date of Patent: May 23, 1989

[54] TAMPER EVIDENT LINK BAGS

[75] Inventors: Steven Ausnit, New York; Per Bentsen, Suffern, both of N.Y.

[73] Assignee: Minigrip, Inc., Orangeburg, N.Y.

[21] Appl. No.: 167,294

[22] Filed: Mar. 11, 1988

[51] Int. Cl.[4] ..... B65D 33/14

[52] U.S. Cl. ..... 383/5; 383/37; 383/63; 383/65; 206/610

[58] Field of Search ..... 383/63, 65, 95, 97, 383/37, 5; 206/610

[56] References Cited

U.S. PATENT DOCUMENTS

| | | | |
|---|---|---|---|
| 3,473,589 | 10/1969 | Gotz | 383/63 X |
| 3,618,286 | 11/1971 | Membrino | 53/29 |
| 4,570,820 | 2/1986 | Murphy | 383/63 X |
| 4,589,145 | 5/1986 | Van Erden et al. | 383/5 |
| 4,630,311 | 12/1986 | Bentson | 383/37 |
| 4,637,060 | 1/1987 | Ausnit | 383/37 |
| 4,665,552 | 5/1987 | Lems et al. | 383/37 |
| 4,744,674 | 5/1988 | Nocek | 383/63 |

FOREIGN PATENT DOCUMENTS

| | | | |
|---|---|---|---|
| 2032882 | 5/1980 | United Kingdom | 383/5 |

*Primary Examiner*—David T. Fidei
*Assistant Examiner*—Nova Stucker
*Attorney, Agent, or Firm*—Hill, Van Santen, Steadman & Simpson

[57] ABSTRACT

Bags with reclosable zippers along their mouth ends and having pull flanges extending above the zippers, have attending upwardly from said pull flanges separably attached tamper evident extensions which are adhesively fixed to one another so that it is necessary to separate the tamper evident extensions from the pull flanges along lines of weakening when it is desired to gain access into the bag through the reclosable zipper. A method of and an apparatus for making the bags in linked chains and a method of and apparatus for filling the linked bags and then completing the filled bags are disclosed.

18 Claims, 3 Drawing Sheets

FIG. 4
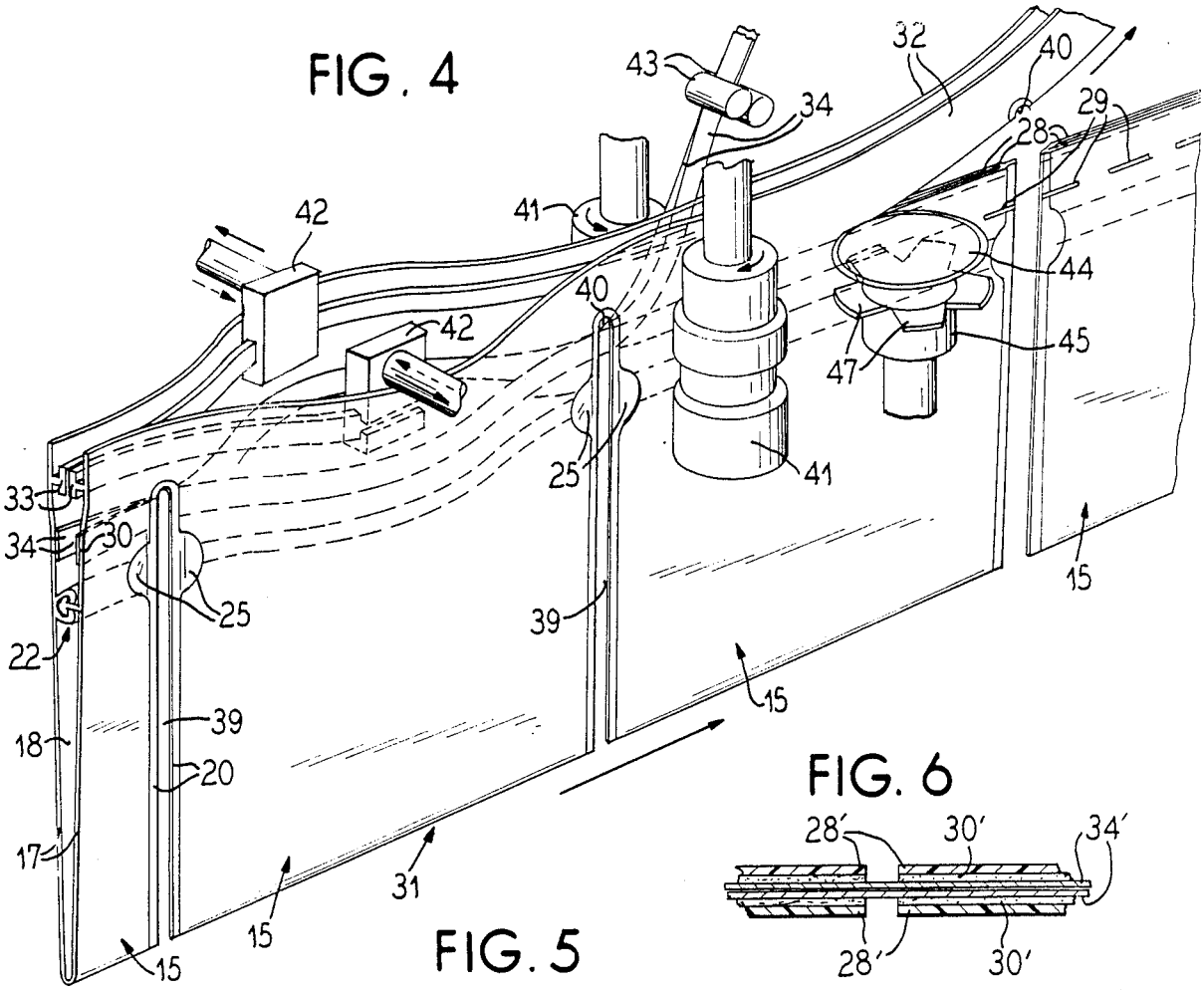
FIG. 6
FIG. 5
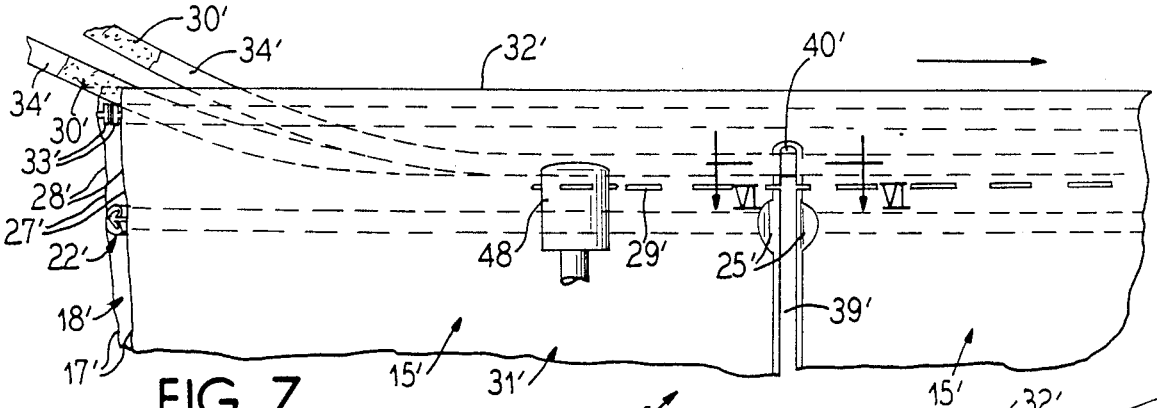
FIG. 7
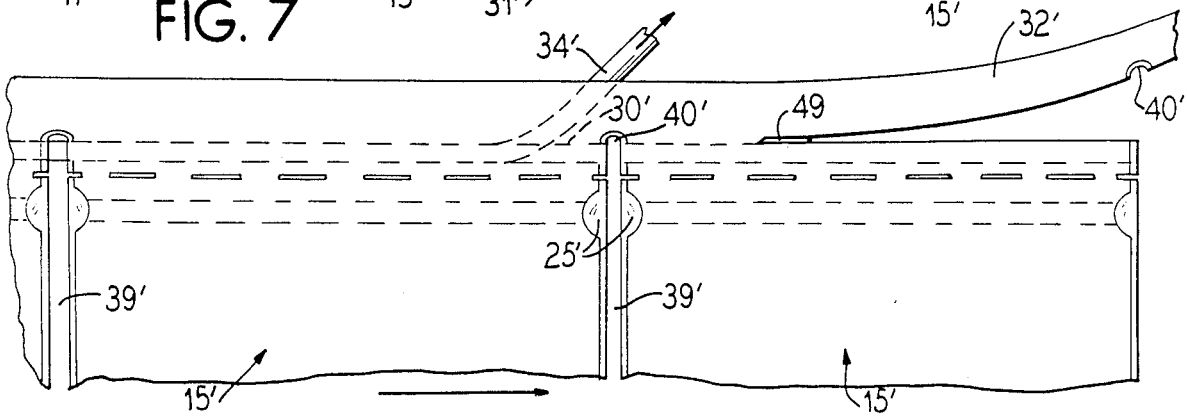

FIG. 8
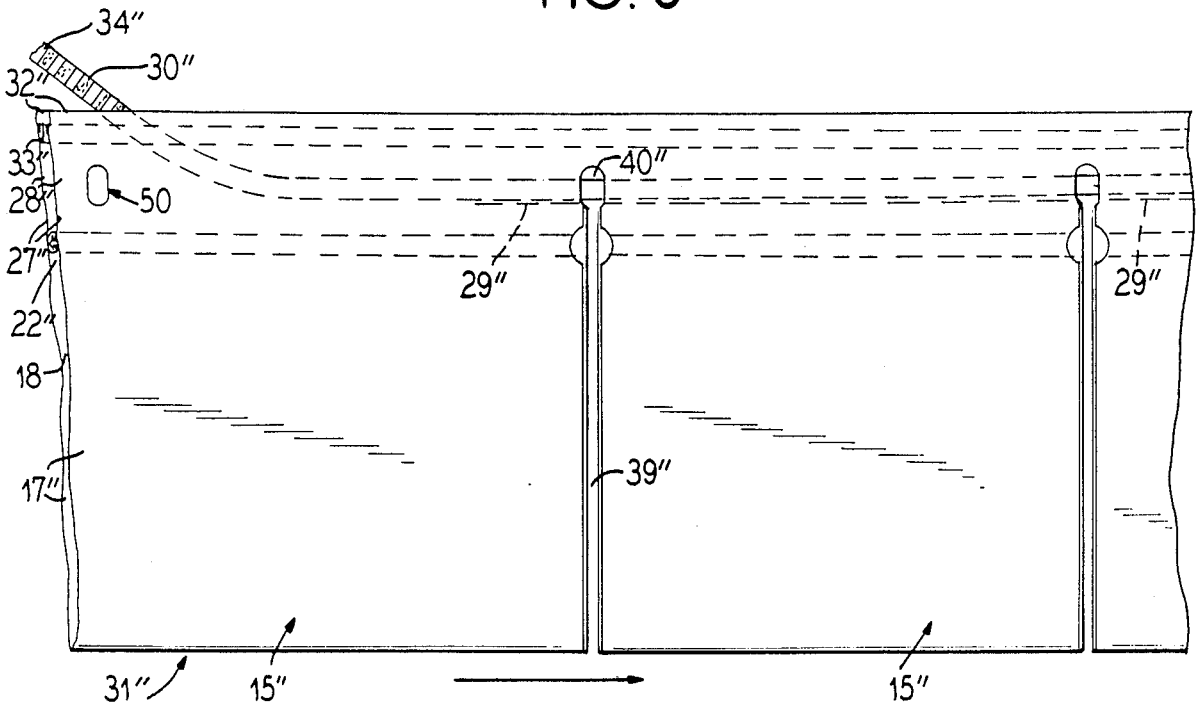
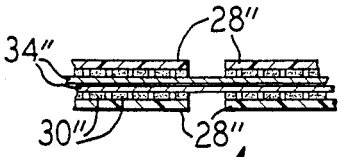
FIG. 9
FIG. 10
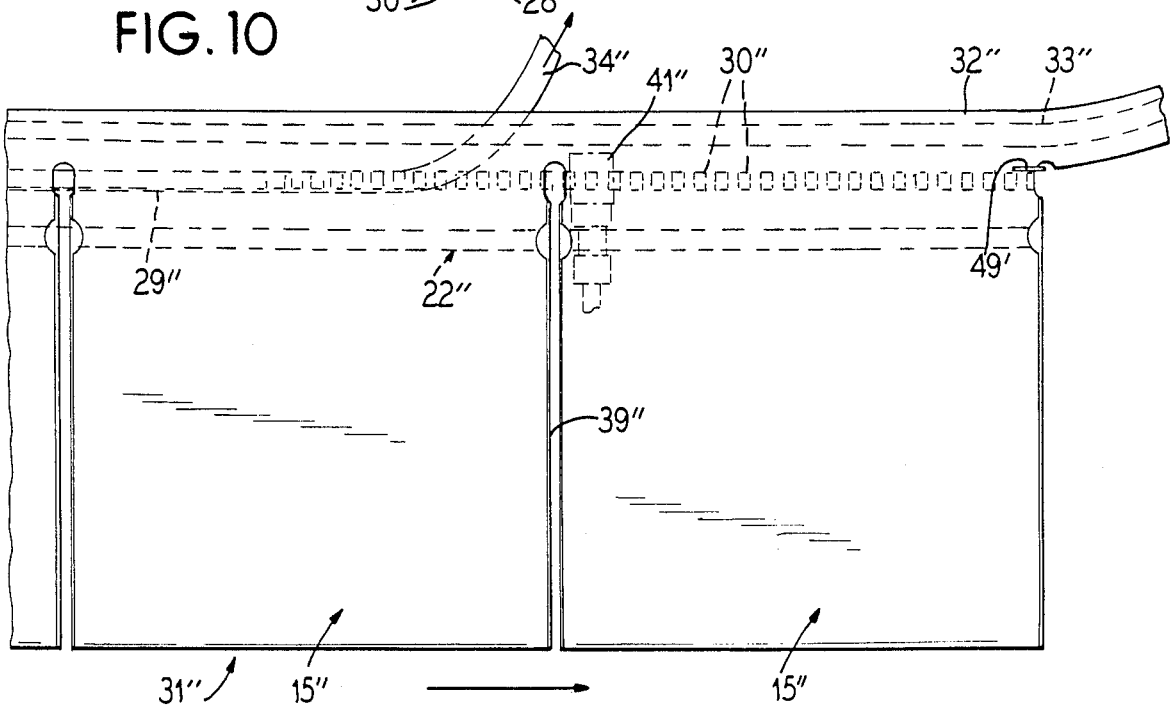

TAMPER EVIDENT LINK BAGS

BACKGROUND OF THE INVENTION

1. Field of the Invention

The present invention relates to link bags and a method of and apparatus for filling the same, and is more particularly concerned with the provision of such bags having tamper evident means.

In U.S. Pat. No. 4,665,552 dated May 12, 1987 and assigned to the same assignee as the present application, there is desclosed an arrangement of integrally serially connected top fillable chain bags especially suitable for manual filling according to a simple method and uncomplicated manually and treadle operated apparatus. The present invention comprises improvements in respect to the disclosure of that patent, and to any extent necessary, the disclosure of that patent is incorporated herein by reference.

Zipper equipped bags filled pursuant to U.S. Pat. No. 4,665,552 are closed at their mouth ends only by the reclosable fastener or zipper. However, there is a need to provide bags of this type with tamper evident means.

Heretofore, tamper evident or tamper proof bags have been heat sealed after filling. In U.S. Pat. No. 3,618,286 dated Nov. 9, 1971, the bags are heat sealed at their top ends after filling through such top ends. In U.S. Pat. No. 4,637,060 dated Jan. 13, 1987 and assigned to the same assignee as the present application, there is disclosed filling of the bags through open bottom ends which bottom ends are then sealed after filling of the bags.

For the user of simple manual link bag filling equipment such as exemplified in U.S. Pat. No. 4,665,552, the heat sealing technique involves unacceptable expense and complication in the apparatus.

SUMMARY OF THE PRESENT INVENTION

It is therefore an important object of the present invention to provide new and improved tamper evident link or chain bags, and which may be used substantially in accordance with the method and apparatus disclosed in U.S. Pat. No. 4,665,552 without necessity of heat sealing to attain the desired tamper evident result.

Pursuant to the present invention, there is provided a top filled bag having opposed wall panels defining a contents pouch closed along opposite sides and a bottom end, and comprising upper bag mouth portions of the panels having reclosable fastener means, pull flange portions of the wall panels extending upwardly from the fastener means, respective upward tamper evident extensions connected to the pull flange portions, and adhesive means for fixedly attaching the extensions to one another, so that the tamper evident extensions must be detached from the pull flange portions for separating the pull flange portions and opening the fastener means for gaining access into the pouch.

For facilitating handling and filling of the bags, the top fillable bags are integrally serially linked in partially separated relation with upper bag mouth portions of the bags having reclosable fastener zipper means, pull flange portions extending upwardly from the zipper means, respective upward tamper evident extensions connected to the pull flange portions, adhesive means carried by the inside surface of at least one of said extensions for fixedly attaching the extensions together in tamper evident manner after the bags have been respectively filled, continuous guide strips extending upwardly from said extensions and linking the bags serially and having guide means thereon for permitting the linked bags to be drawn slidably through bag opening means in a filling apparatus, means detachably connecting said strips to said extensions, and said strips being removable from said extensions after the bags have been filled and said adhesive means then acting, after the filling, for fixedly securing the extensions to one another in tamper evident manner.

BRIEF DESCRIPTION OF THE DRAWINGS

FIG. 4 is a schematic elevational view showing how the link bags according to the present invention are adapted to be filled, closed and separated;

FIG. 5 is a fragmentary elevational view showing a modified arrangement for equipping the link bags with tamper evident means;

FIG. 6 is an enlarged fragmentary sectional detail view taken substantially along the line VI—VI in FIG. 5;

FIG. 7 is a fragmentary side elevational view showing how tamper evident bags of FIG. 5 are adapted to be completed and separated after filling;

FIG. 8 discloses another modified method of equipping the chain of link bags with tamper evident means;

FIG. 9 is an enlarged fragmentary sectional detail view taken substantially along the line IX—IX in FIG. 8; and FIG. 10 is a fragmentary schematic elevational view showing closing of, and separation of, the bags of FIG. 8.

DETAILED DESCRIPTION

Figure 1:
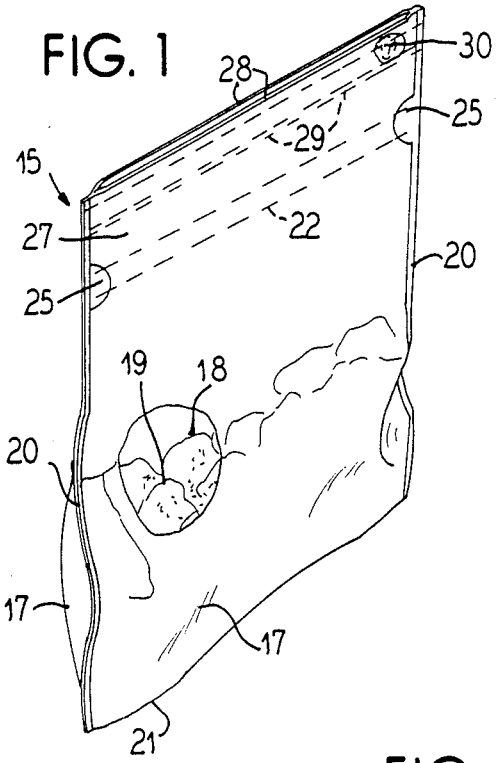
FIG. 1 is a perspective view of a filled tamper evident link bag according to the present invention.

A tamper evident bag 15 (FIG. 1) has opposite wall panels 17 which may be made from suitable plastic film such as polyethylene. Between the wall panels 17 is provided a pouch 18 for contents 19. On opposite sides of the bag the pouch is closed, as by means of heat seal seams 20. A closure 21 for the bottom end of the bag may be formed either by a fold connecting the wall panels 17 or by means of heat seal seaming where the wall panels are formed from separate strips of the bag material.

Figure 3:
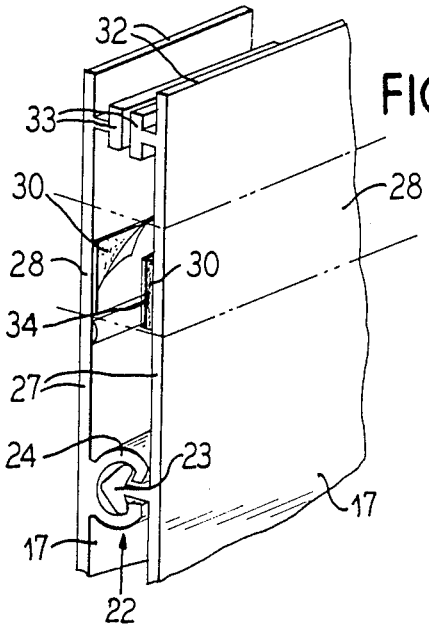
FIG. 3 is an enlarged fragmentary sectional detail view taken substantially along the line III—III in FIG. 2.

At its upper end, the bag 15 has a mouth portion provided with reclosable fastener zipper means 22, the structure of which is best visualized in FIG. 3. In the present instance, the zipper 22 includes a generally arrow shape rib male profile 23 fixed on the inside of one of the wall panels 17 and a complementary generally groove shaped female profile 24 on the inside of the other of the wall panels 17. Opposite ends of the zipper 22 are integrated into the side seals 20 by means of spot seals 25. Pull flange portions 27 of the wall panels 17 extend upwardly from the zipper means 22. Respective integral upward tamper evident extensions 28 are connected separable to the pull flanges 27 along weakened lines 29 comprising perforation such as short disconnected slits.

Adhesive means 30 fixedly attaches the extensions 28 to one another in face-to-face relation. Thereby, in order to gain access into the bag pouch 18 through the reclosable zipper 22, the tamper evident extensions 28 must be detached from the bag by ripping them off of the pull flanges 27 along the weakened lines 29. An effective tamper evident removable closure device is thus provided for the bag 15.

Figure 2:
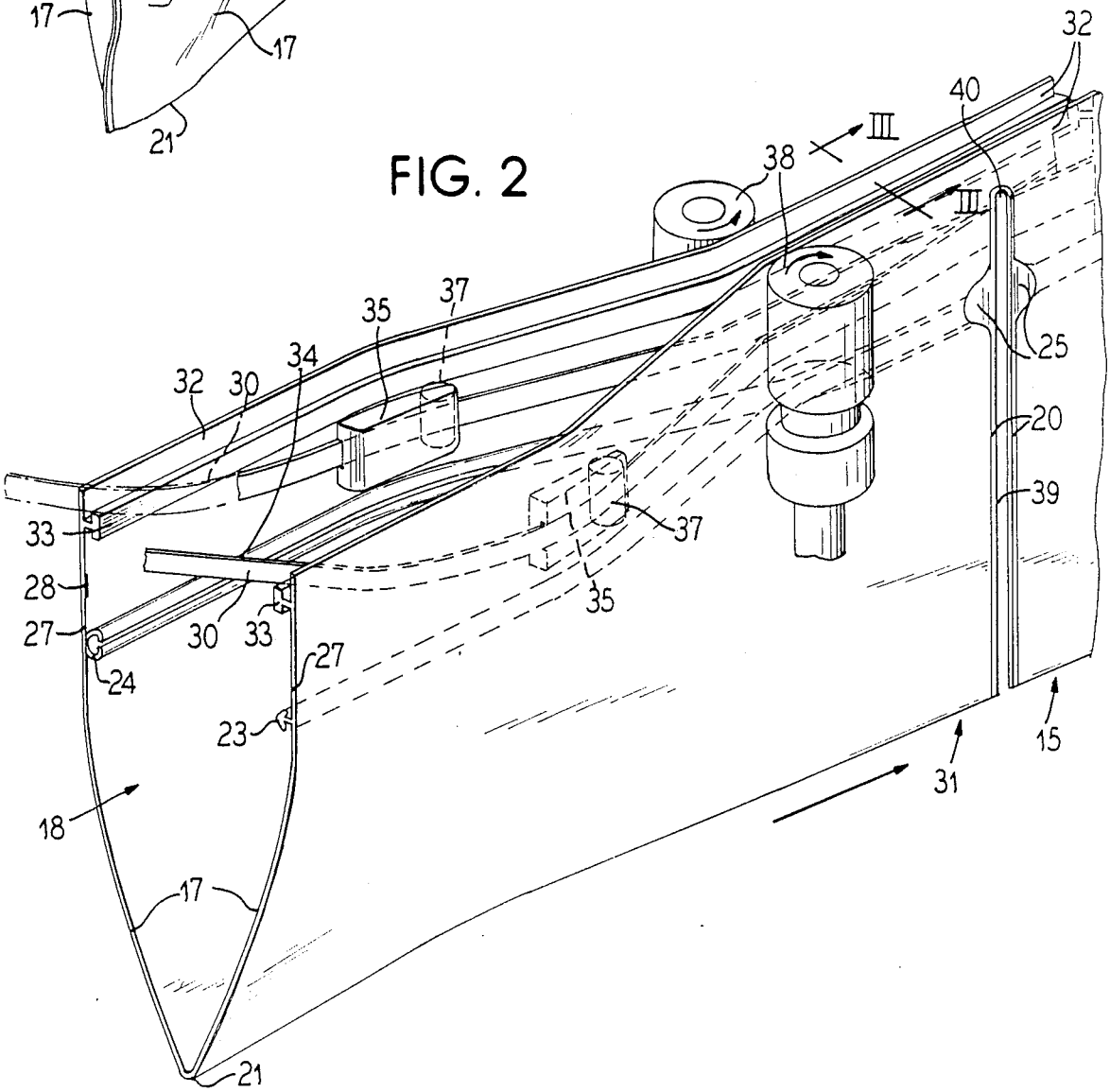
FIG. 2 is a schematic view showing how a chain of link bags may be equipped with adhesive means for the tamper evident structure of the bag.

For filling the bags 15 in the manner disclosed in U.S. Pat. No. 4,665,552, the bags are desirably supplied in a chain 31 wherein continuous respective supporting, guiding and linking strips 32 extending upwardly from the tamper evident extensions 28 link the successive bags 15 in the chain (FIGS. 2 and 3). The linking strips 32 carry along their inner faces guide ribs 33.

In fabrication of the bag chain 31, the wall panels 17 which have integrally therewith the respective zipper profiles 23 and 24, the pull flange portions 27, the extensions 28 and the guide strips 32 may be folded up along the bottom closure fold 21 from a continuous length of flat plastic film sheet, or the chain bag material may be formed up from a tubular extrusion and split to separate the strips 32 and the tubular extrusion collapsed upon itself. Whether the bag material is made from a flat sheet or from a split and flattened tubular extrusion, the adhesive 30 whether in one stripe or two stripes is preferably applied in a performed manner to the preformed bag material. Desirably, the adhesive stripes 30 may be of the pressure sensitive kind carried by cover strips 34 fed from a suitable source and guided into position on the bag making material by means of guide blocks 35 and complementary pressure rolls 37. Thereafter, the wall panels 17 of the assembly are joined and the zipper profiles 23 and 24 interlocked by means of pressure rolls 38.

Following this, the bag making material assembly is formed with separation slots 39 as by means of heat sealing for which technology is well known and which provides the side heat seal seams 20. At this time, also, the spot seals 25 are formed. Each separation slot 39 extends from an open lower end to a closed upper end 40 extending into the rib-carrying strips 32 just below the ribs 33. During all these procedures, the adhesive cover strips 34 prevent the adhesive stripes 30 from joining.

In order to avoid fusion or burning of the cover strips 34 and the adhesive strips 30 during forming of the slots 39, the cover strips and the adhesive are formed from material which has a higher melting point or char point than the temperature at which the plastic material of the wall panels 17 and the fastener profiles 23 and 24 will fuse, so that the strips 34 can extend uninterruptedly across the slots 39 as best seen in FIG. 2. The indicated process of applying the adhesive strips 30 to the tamper evident extensions 28 can be carried out right after the extrusion of the zipper or zipper film or during the manufacture of the bag chain.

The bag making chain 31 with the mouth end components of the assembly retained by the zipper 22 in face-to-face assembled relation is ready to be run through filling and bag sealing and separating equipment. Generally, the bag chain 31 will be manufactured in a plant especially equipped for that prupose and the bag chain rolled up or otherwise packaged for delivery to a bag filling, sealing and separation site.

Referring, now, to FIG. 4, there is exemplified a bag filling and final bag processing apparatus in general according to the disclosure in U.S. Pat. No. 4,665,552. In such apparatus, while the bag chain 31 is advanced step-by-step between suitably supported pinch rolls 41, each successive bag is opened by reciprocating combination bag supporting and opening jaws 42. The jaws 42 support the bag chain by complementary, slidable engagement of the generally T-shaped ribs 33. As shown, the jaws 42 are in the bag opening position, and it will be understood that the bag opening maneuver will be accomplished as each of the bag sections 15 of the chain 31 reaches a generally vertically centered relation to the jaws 42 whereupon the jaws will be separated for opening the bag section as shown and the bag section filled manually or automatically whereupon the jaws are returned to the generally closed bag position, in each cycle of operation. During the bag filling operation, the adhesive cover strips 34 protect the jaws 42 against befouling by the adhesive 30, and protect the adhesive from possible contamination by the bag fill being loaded into the bag section 15.

After each bag section 15 has been filled, the bag chain 31 is advanced one bag section through the rolls 41. As such advance occurs, the cover tapes or strips 34 are stripped from the pressure sensitive adhesive 30 immediately upstream from the pinch rolls 41, and drawn away from the bag chain assembly such as by means of driven stripping rollers 43. Then, the pinch rolls 41 pinch the mouth end of the filled bag closed, not only reclosing the zipper 22, but also sealingly joining the bared adhesive stripes 30.

As the filled bag 15 advances from the rolls 41, the rib carrying strips 32 are severed, as by rotary cutoff knife means 44 on a spindle 45, from the adhesive carrying tamper evident extensions 28. Desirably, as the knife means 44 severs the strips 32, rotary perforator means 47 carried by the spindle 45 forms the weakened-line perforations 29. Operation of the cutter 44 cuts across the upper end 40 of the separation 39 that partially separates the leading filled bag 15 from the next succeeding bag 15, and thus detaches the leading filled bag 15 from the chain. The detached bag 15 may then be further handled as desired such as by being stacked and packed for sales purposes. By virtue of the tamper evident extensions 28 on the filled bags 15, any attempt by any unauthorized persons to gain access into the mouth end of the bags will be apparent. Legitimate access into the bag can be readily attained by ripping the tamper evident extension structure 28 from the bag 15 along the weakened line or lines 29.

In a slight modification as shown in FIGS. 5, 6, and 7, the bag sections 15' in the bag chain 31' are essentially the same in basic construction as the bags 15 in the bag chain 31 of FIGS. 2–4 and primed reference numerals represent corresponding elements. As the adhesive stripes 30' are applied with their cover strips 34' to the tamper evident extensions 28' of the bags 15' in the chain 31',a perforator 48 shown as of the rotary type, forms the line of weakening perforations 29' at the juncture of the pull flanges 27' with the tamper evident extension means 28' (FIG. 5).

Then, after each bag 15' has been filled (FIG. 7) and the cover strips 34' removed from the adhesive 30', and the filled bag 15' advanced through closing means such as rollers shown in FIG. 4, the guide strip means 32' is severed from the leading filled bag by means such as a severance knife 49.

While the bag chain 31' is advancing through the filling apparatus, the continuous cover strips 34' (as also the cover strips 34 in FIGS. 2–4) cooperate with the continuous guide strips 32' in retaining the bags 15', or 15, as the case may be, in stable connected relation in the bag chain 31', or 31. Stripping of the cover strips 34', or 34, facilitates separation of the leading filled bag from the bag chain upon severance of the guide strips from the top edge of the bag chain.

In FIGS. 8, 9 and 10, an arrangement similar to FIGS. 5–7 is depicted and wherein double primed reference numerals identify elements corresponding to the similar elements in the other embodiments described herein. The difference in this embodiment of the invention resides, among other things, in that for the upper end portions 40'' of the separations 39'', holes 50 are punched in the tamper evident extensions 28'' in advance of joining of adhesive-carrying cover tapes 34'' with the extensions 28''. In this instance, the adhesive stripes 30'' are in the form of substantially uniformly closely spaced spots or patches which may, for some purposes, be preferred to a continuous stripe of the adhesive. Downstream from the joining of the adhesive carrier and cover tapes 34'' to the bag sections 15, the separations 39'' are formed with the upper ends thereof joining the prepunched holes 50 to provide the closed ends 40'' for the separations. After filling of each bag section 15'' of the bag chain 31'', similarly as in FIG. 7, now exposed adhesive 30'' is pressed into sealing relation to the tamper evident extensions 28'' as by means of rollers 41'' which also press the zipper 22'' closed. Each of the leading filled bag sections 15'' is severed from the guide strip 32'' by means of a cutter 49'.

Although cooperating dual stripes of adhesive have been disclosed for sealing the tamper evident upward extensions from the pull flanges of the bags for utmost sealing reliability under most circumstances, a single such adhesive stripe applied to one of the tamper evident extension for final sealing of the tamper evident means by sealing engagement with the opposite upward extension may be adopted if preferred where a satisfactory adhesive seal can be thus provided. The important consideration is that the tamper evident extensions of the bags be fixedly sealed to avoid access into the bag until the tamper evident extensions along the top of the bag are detached.

It will be understood that variations and modifications may be effected without departing from the spirit and scope of the novel concepts of the present invention.

We claim as our invention:

1. A top filled bag having opposed wall panels defining a contents pouch closed along opposite sides and a bottom end, and comprising:

an upper mouth portion of the bag having reclosable fastener means;

pull flange portions of said wall panels extending upwardly from said fastener means;

respective upward tamper evident extensions separably connected to said pull flange portions; and a line of adhesive means separately applied to the inner surface of each of said extensions and coacting for fixedly attaching said extension to one another, so that said tamper evident extensions must be detached from said pull flange portions for separating said pull flange portions and opening said fastener means for gaining access into said pouch.

2. A bag according to claim 1, wherein said tamper evident extensions are each separably connected to said pull flange portions by a line of weakening.

3. A bag according to claim 2, wherein each of said lines of weakening comprises perforations.

4. A bag according to claim 1, each of said lines of adhesive means comprises a continuous stripe of adhesive.

5. A bag according to claim 1, wherein each of said lines of adhesive comprises a succession of closely adjacent spots of adhesive.

6. A chain of top fillable bags integrally serially linked in partially separated relation with upper bag mouth portions of the bags having reclosable fastener zipper means and pull flange portions extending upwardly from the zipper means, and comprising:

respective upward tamper evident extensions connected to the pull flange portions;

adhesive means carried by at least one of said extensions for fixedly attaching the extensions together in tamper evident manner after the bags have been respectively filled;

continuous guide strips extending upwardly from said extensions and linking the bags serially and having guide means thereon for permitting the linked bags to be drawn slidably through bag opening means in a filling apparatus;

means detachably connecting said strips to said extensions; and said strips being removable from said extensions after the bags have been filled and said adhesive means then acting after the filling for fixedly securing the extensions to one another in tamper evident manner.

7. Bags according to claim 6, wherein the adhesive is of pressure sensitive type, and cover means over the adhesive and adapted to be stripped after the bags are filled.

8. Bags according to claim 6, wherein said adhesive comprises at least one substantially continuous stripe along the bag chain, and removable cover tape means covering the adhesive stripe.

9. Bags according to claim 6, wherein said adhesive comprises substantially continuous line of closely spaced adhesive spots along the inside of one of the tamper evident extensions of the bags in the chain and protective cover tape means over the adhesive.

10. Bags according to claim 6, having separations therebetween opening at the bottom of the chain and extending into the lower portion of the guide strips so that severence of the guide strips from said tamper proof extensions will result in detachment of filled bags from the bag chain.

11. Bags according to claim 10, wherein said lower portion of the guide strips have holes into which the upper ends of the separations extend.

12. Bags according to claim 6, wherein said adhesive means comprises a line of adhesive separately carried by the inner surface of each of said extensions and coacting for fixedly attaching said extensions to one another.

13. Bags according to claim 6, wherein said tamper evident extensions are each separably connected to said pull flange portions by a line of weakening.

14. Bags according to claim 13, wherein each of said lines of weakening comprises perforations.

15. Top fillable bags integrally serially linked in partially separated relation with upper bag mouth portions of the bags having reclosable fastener zipper means, and pull flange portions extending upwardly from the zipper means, and comprising:

respective upper tamper evident extensions connected to the pull flange portions;

adhesive means on the inside surface of at least one of said extensions for fixedly attaching the extensions together in tamper evident manner after the bags have been respectively filled;

continuous guide strips extending upwardly from said extensions and linking the bags serially; and guide means along the guide strips for permitting the linked bags to be drawn slidably through bag opening means in a filling apparatus.

16. Bags according to claim 15, comprising a protective cover strip means on said adhesive.

17. Bags according to claim 15, wherein said adhesive means is in the form of a continuous series of closely spaced spots of adhesive.

18. Bags according to claim 15, comprising separations separating said bag along lines extending upwardly from the lower ends of the bags into said guide strips, and holes in said guide strips into which said separations extend.

* * * * *